US005820402A

United States Patent [19]

Chiacchio et al.

[11] Patent Number: 5,820,402

[45] Date of Patent: Oct. 13, 1998

[54] ELECTRICAL TERMINAL CONSTRUCTED TO ENGAGE STACKED CONDUCTORS IN AN INSULATION DISPLACEMENT MANNER

[75] Inventors: Duilio Chiacchio, Mendoza, Argentina; Paolo Castello, Torino, Italy

[73] Assignee: The Whitaker Corporation, Wilmington, Del.

[21] Appl. No.: 732,386

[22] PCT Filed: Apr. 18, 1995

[86] PCT No.: PCT/IB95/00266

§ 371 Date: Oct. 22, 1996

§ 102(e) Date: Oct. 22, 1996

[87] PCT Pub. No.: WO95/31014

PCT Pub. Date: Nov. 16, 1995

[30] Foreign Application Priority Data

May 6, 1994 [GB] United Kingdom ..... 9409035
May 6, 1994 [GB] United Kingdom ..... 9409036

[51] Int. Cl.[6] ..... H01R 13/40

[52] U.S. Cl. ..... 439/398; 439/408

[58] Field of Search ..... 439/398, 400, 439/408

[56] References Cited

U.S. PATENT DOCUMENTS

| | | | |
|---|---|---|---|
| 3,805,214 | 4/1974 | Demler et al. | 339/17 |
| 3,860,318 | 1/1975 | Reavis, Jr. et al. | 339/99 |
| 3,897,128 | 7/1975 | Reavis, Jr. | 339/98 |
| 3,897,993 | 8/1975 | Fleischhacker et al. | 339/99 R |
| 3,950,062 | 4/1976 | Reavis, Jr. | 439/408 |
| 4,039,239 | 8/1977 | Cobaugh et al. | 439/398 |
| 4,060,302 | 11/1977 | Saligny | 339/97 |
| 4,111,512 | 9/1978 | Parmer et al. | 339/105 |
| 4,118,096 | 10/1978 | Takahashi | 439/400 |
| 4,140,360 | 2/1979 | Huber | 339/176 |
| 4,141,618 | 2/1979 | Reavis, Jr. et al. | 339/97 |
| 4,199,211 | 4/1980 | Kidder | 339/98 |
| 4,210,378 | 7/1980 | Baribeau | 339/97 |
| 4,283,105 | 8/1981 | Ferrill et al. | 339/97 R |
| 4,343,529 | 8/1982 | Reavis, Jr. et al. | 339/198 R |
| 4,363,529 | 12/1982 | Loose | 439/398 |
| 4,448,472 | 5/1984 | Hardesty | 439/400 |
| 4,448,473 | 5/1984 | Felix et al. | 339/99 R |
| 4,547,034 | 10/1985 | Forberg et al. | 339/97 P |
| 4,575,173 | 3/1986 | Chapin et al. | 339/97 R |
| 4,705,340 | 11/1987 | Loose | 439/395 |
| 4,795,364 | 1/1989 | Frantum, Jr. et al. | 439/407 |
| 4,897,040 | 1/1990 | Gerke et al. | 439/401 |

FOREIGN PATENT DOCUMENTS

| | | | |
|---|---|---|---|
| 0 021 731-A1 | 1/1981 | European Pat. Off. | H01R 4/24 |
| 2 206 598 | 6/1974 | France | H01R 23/56 |
| 2 330 159 | 5/1977 | France | H01R 9/08 |
| 2 419 594 | 10/1979 | France | H01R 13/38 |
| 39 12 955 A1 | 10/1990 | Germany | H01R 4/24 |
| 2130815 | 6/1984 | United Kingdom | 439/408 |

OTHER PUBLICATIONS

PCT International Search Report (see PCT Publication).

*Primary Examiner*—Gary F. Paumen
*Assistant Examiner*—Tho D. Ta
*Attorney, Agent, or Firm*—Driscoll Nina

[57] ABSTRACT

Electrical terminal having an insulation displacement contact for electrically engaging multiple conductors received therein. The IDC includes a first contact region in-line with, a second contact region such that multiple conductors may be received in a staked manner with the first conductor receiving region is located in-line with a second conductor receiving region and separated therefrom by a fulcrum.

5 Claims, 4 Drawing Sheets

ELECTRICAL TERMINAL CONSTRUCTED TO ENGAGE STACKED CONDUCTORS IN AN INSULATION DISPLACEMENT MANNER

BACKGROUND OF THE INVENTION

1. Field of the Invention

This invention relates to an electrical terminal having an insulation displacement contact portion for electrically engaging an electrical conductor, in particular, to an insulation displacement contact portion to engage multiple in-line conductors.

SUMMARY OF THE PRIOR ART

There are numerous applications where it is desirable to interconnect multiple conductors to a single contact of an electrical device. One example would be in a clothes washing machine. This machine has a process controller with a signal contact to stop the washing process if one of various conditions occur, for example opening the lid or completion of a washing cycle. In order to interconnect the various signal conductors to a common contact, the contact may be adapted to include a number of various connection points, such as tabs, depending on the number of sensors that may be utilized. Therefore, a manufacturer must maintain a supply of various controllers which are only different in the number of connection points or the manufacture must utilize a single controller with enough connection points to encompass all of the possible variations of their product line. A solution to this inefficiency is to provide a single connection point at the contact and interconnect the multiple signal conductors to an electrical terminal that is constructed to be connectable to the connection point.

In order to reduce time and associated costs in assembly operations, a known electrical terminal used to interconnect insulated conductors, such as a conventional insulated wire, includes an Insulation Displacement Contact (IDC) to engage the insulated conductor without the need to strip the insulation from the end of the conductor. A typical IDC is formed of spaced apart opposing walls that extend upward from a base to form an open slot that includes a cutting portion at the opening of the slot followed, in the direction of insertion of the insulated conductor, by a contact portion. As the insulation coated conductor is inserted into the slot, the cutting portion separates the insulation to expose the conductor and, upon further insertion, the conductive core is engaged by the contact portion. The conductor is physically retained within the slot for electrical engagement with the terminal by the resiliency of the opposing walls.

The vast majority of electrical terminals that incorporate IDC technology engage a single insulated conductor. The electrical terminals that use IDC technology to engage multiple leads typically do so by way of a plurality of IDC slots arranged adjacent to each other where each one receives a single conductor. In essence, the IDC portion of the terminal contains an array, typically a row, of adjacent conventional IDC slots formed upon a common base for a side-by-side arrangement of conductors, where each conductor is located in an adjacent one of the array of IDC slots. This produces a large IDC platform. In order to reduce the size of the IDC portion, it would be desirable to arrange the insulated conductors in a stacked fashion. By stacked fashion, what is meant is that the insulated conductors are arranged one over the other; however, it is important to note that this need not be vertical and orientation terms used herein are for convenience of description and are not meant to be limiting. Unfortunately, as it is the resilience of the opposing walls that retain the conductor in electrical engagement within the slot, tight engagement of a first conductor towards the bottom of the IDC slot of a conventional structure would cause the free ends of the walls to splay. This makes it difficult to assure a tight and lasting engagement with the second conductor that is stacked thereupon. What is needed is an IDC portion that enables reliable engagement of multiple conductors in a stacked manner.

It is an object of this invention to provide an IDC portion for engaging a plurality of conductors.

It is another object of this invention to provide an IDC portion having multiple aligned IDC slots for receiving multiple conductors in a stacked manner.

It is yet another object of this invention to provide such a terminal in a simple and economical manner.

SUMMARY OF THE INVENTION

FR-A-2330159 discloses an electrical terminal comprising an insulation displacement contact section having a first insulation displacement contact and a second insulation displacement contact for engaging a first diameter insulated conductor and a second diameter insulated conductor respectively wherein the first diameter insulated conductor is smaller than that of the second. Each insulation displacement contact includes a contact region that is longitudinally aligned for receiving the first and second conductor in a stacked manner.

An aspect of this invention is accomplished by providing an electrical terminal comprising an IDC portion having a first IDC and a second IDC for engaging respective insulated conductors, each IDC includes a contact region wherein the respective conductor is received, the first IDC and the second IDC are aligned one in front of the other so that the insulated conductors are received in a stacked fashion, where each IDC includes a pair of legs joined together at one end and extending therefrom in a U-shaped manner to define a respective IDC slot, each slot having a contact region proceeded by an insulation separating portion, the first and second IDC being oriented such that the conductor received in the contact region of the second IDC passes through the contact region of the first IDC, the contact characterized in that the slot of the first IDC includes a relieved portion that extends below the contact region of the first IDC and is aligned with the contact region of the second than that of the same slots contact region and the first IDC is joined to the second IDC along one corresponding leg, whereby engagement of the first conductor is not adversely effected by engagement of the second conductor.

Another aspect of this invention is accomplished by providing first and second IDC regions that are longitudinally aligned and axially offset from each other.

Yet another aspect of this invention is accomplished by providing an IDC slot having first and second IDC regions separated by a fulcrum.

Advantageously, this enables IDC engagement of multiple stacked conductors, thereby minimizing the space required for a multiple conductor electrical termination utilizing IDC technology. This terminal enables IDC engagement of multiple conductors within a single IDC slot, thereby possibly eliminating the need to form multiple cutting edges and reducing the overall size of the terminal. Furthermore, in one embodiment, the IDC slot is constructed such that the electrical engagement of the first conductor is enhanced by the engagement of the second conductor, contrary to the prior art devices where the engagement of the second conductor degrades the engagement with the first conductor. Additionally, terminals according to the present invention may be formed in a one piece construction.

BRIEF DESCRIPTION OF THE DRAWINGS

The present invention will now be described by way of example with reference to the accompanying drawings, in which.

DETAILED DESCRIPTION OF THE PREFERRED EMBODIMENTS

Figure 1:
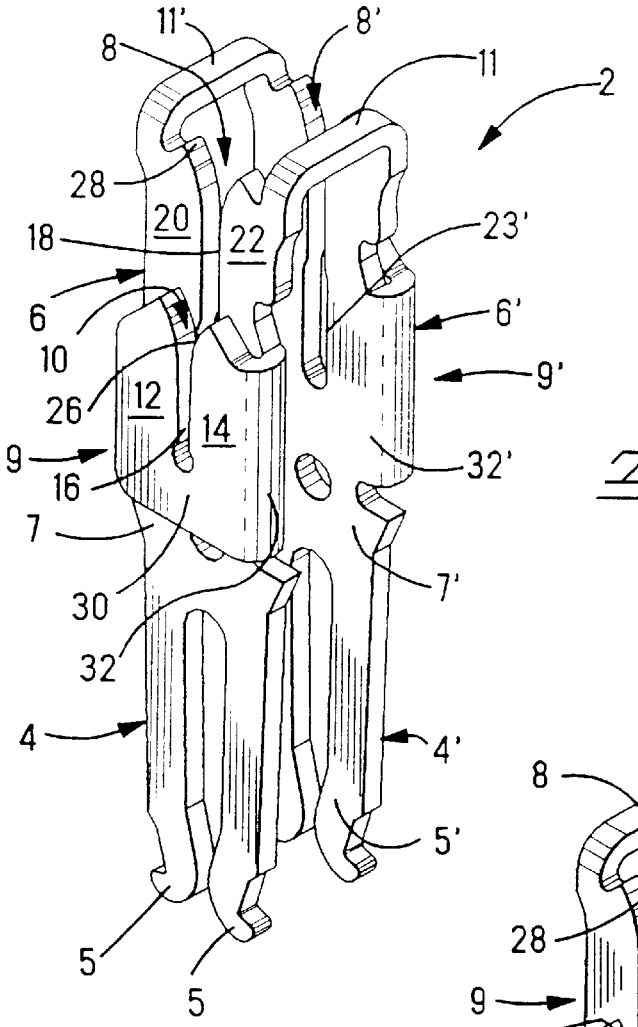
FIG. 1 is a perspective view of an electrical terminal having an IDC portion for receiving stacked conductors.
Figure 2:
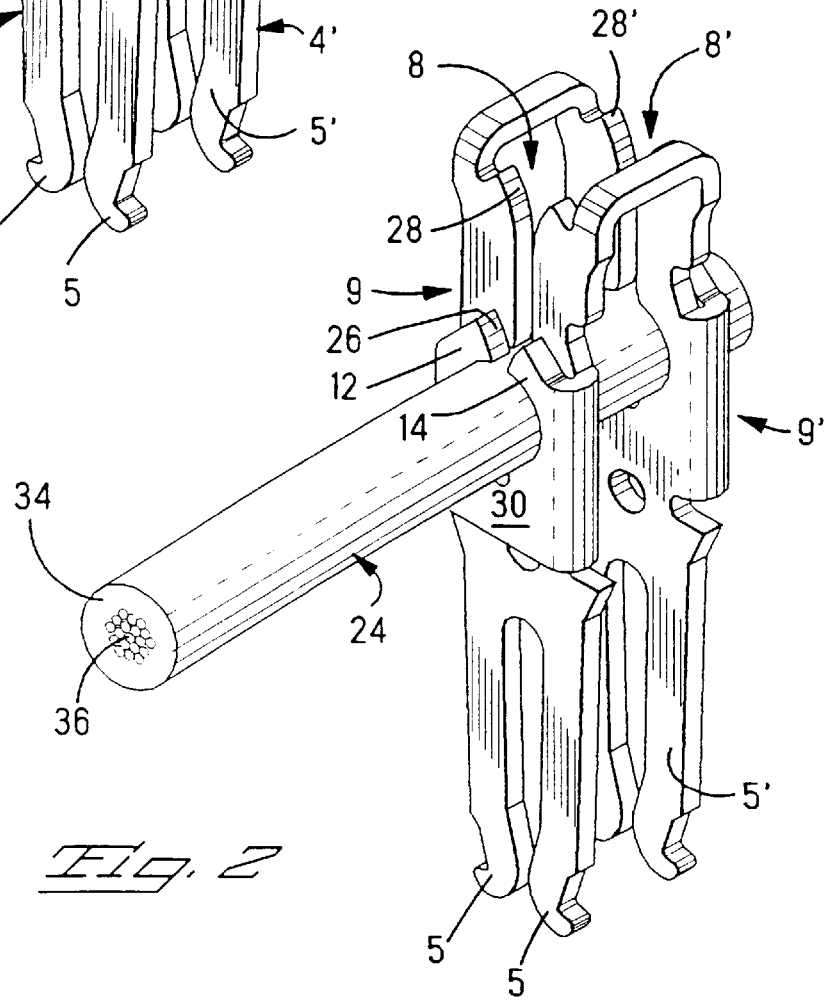
FIG. 2 is an perspective view of the electrical terminal of FIG. 1 showing a first conductor received within the second IDC.
Figure 3:
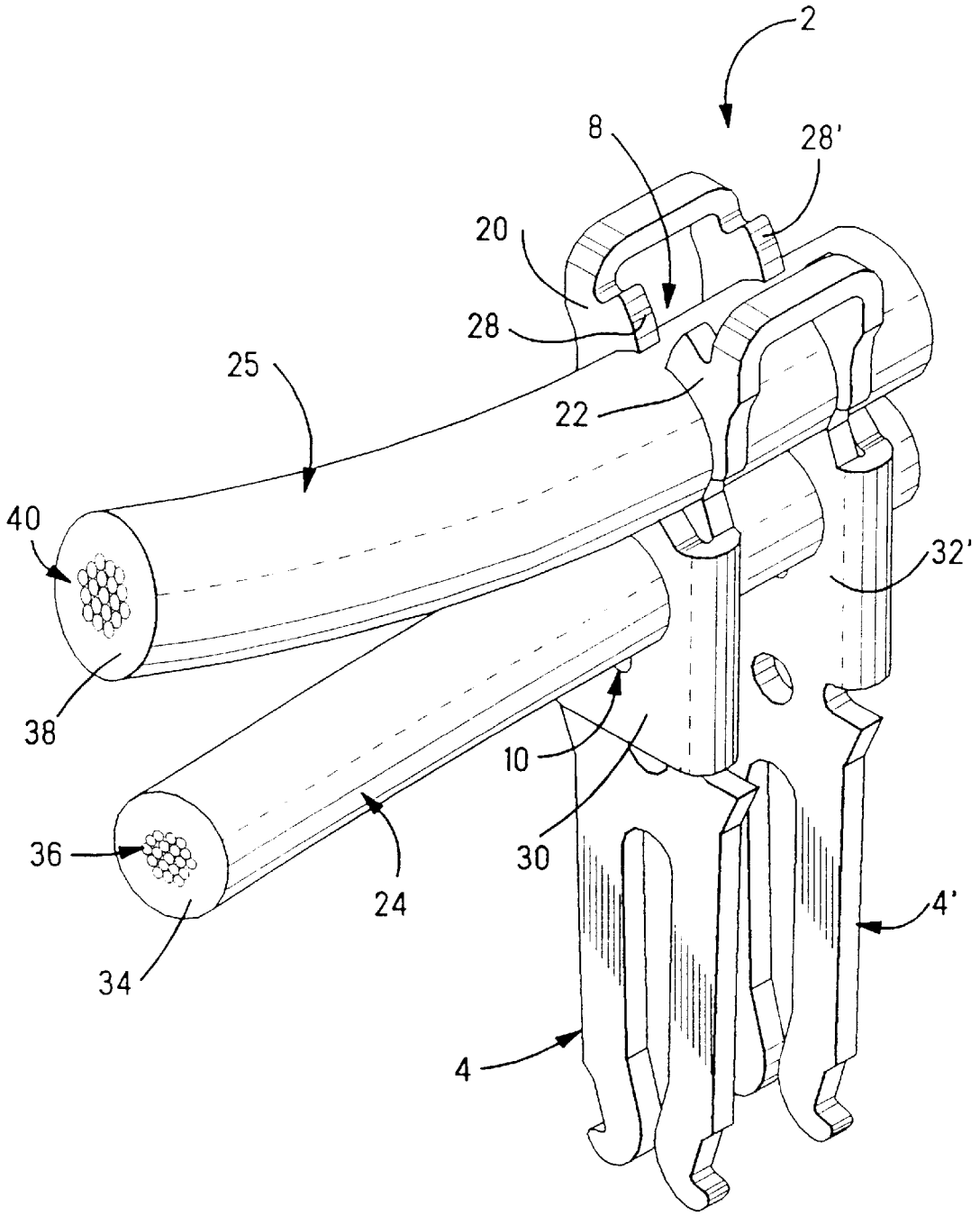
FIG. 3 is an perspective view of the electrical terminal of Figure showing multiple conductors received within respective IDCs.

Referring first to FIG. 1, an electrical terminal according to the present invention is shown generally at 2. The particular embodiment shown in FIGS. 1–3 is a single piece unit that is formed from a material having the desired electrical and mechanical properties. The electrical terminal 2 is generally U-shaped having two basically identical leg portions 9,9' folded from straps 11,11'. For convenience, only one of these legs 9,9' will be described in detail. It should be noted however, that these legs 9,9' need not be identical and that more or less legs may be incorporated into a terminal according to the present invention.

Each of the legs 9,9' include a device contact portion 4,4' and an IDC portion 6,6'. The device contact portion 4 is for engaging a contact point on a mating electrical device (not shown). In this particular embodiment, the contact portion 4 includes multiple terminal engaging legs 5. It should be appreciated however, that the device contact portion 4 may take on any configuration necessary to interface with the particular electrical contact point of the device. For example, it would be possible to incorporate a foot for surface mount solder electrical connection, a pin for plated through hole electrical connection or a socket to interface with an electrical connector. The IDC portion 6 is constructed to engage multiple stacked insulated electrical conductors 24,25, as shown in FIG. 3. The IDC portion 6 will be described below and is connected to the device contact portion 4 by an intermediate portion 7.

The IDC portion 6 that extends from the intermediate portion 7 includes a first IDC 8 and a second IDC 10. Each of these IDCs 8,10 are formed as a generally U-shaped slot open at one end to receive the electrical conductors. The first IDC 8 includes opposing cutting edges 28 on walls 20,22 that define the first IDC 8. The second IDC 10 includes opposing cutting edges 26 on walls 12,14 that define the second IDC 10. Each of the IDC's 8,10 include a contact seat 16,18 wherein the respective conductor 25,24 is electrically engaged.

The walls 20,22 that form the first IDC 8 lie in generally the same plane as the intermediate portion 7 and the contact portion 4. The walls 12,14 that define the second IDC lie in a plane that is offset from the plane of walls 20,22. This offset is achieved by forming a flap 30 that is folded back from edge 32 of wall 22. It would be possible, if desired, to form a tab to affix the flap 30 at its free end to wall 20 or to do so by way of another means, such as welding. This flap 30 is configured so that the first IDC 8 and the second IDC 10 are longitudinally aligned with each other. As can be observed in the FIGS. 1–3, contact regions 16,18 are axially offset from each other, in these Figures one above the other, so that stacked conductors 25,24 may be received within their respective IDC 8,10 to seat in the desired contact region 16,18.

With reference now to FIG. 2, the first conductor 24 is inserted into the electrical terminal 2 by aligning the conductor 24 with the first IDC 8 and pressing down so that the opposing cutting edges 28 cut through the insulation 34 surrounding the conductive core 36 of the conductor 24. The first conductor 24 is further inserted and comes into contact with opposing cutting edges 26 of the second IDC 10. A relieved portion 23' (FIG. 1) extends below the contact region 18 of the first IDC, 8 behind the second IDC 10, so that conductor 24 may be pressed past cutting edges 26 which further cuts the insulation 34 so that the conductive core 36 enters the second contact seat 16 and establishes electrical interconnection therewith. The resiliency of walls 12,14 maintain the electrical interconnection while the relieved portion 23 enables walls 20,22 to accept the second conductor 25 with their resiliency unaffected by the insertion of the first conductor 24. The cutting edges 26 of the second IDC slot 10 may also be formed as wedges where the cuts in the insulation of the first conductor 24 established by the cutting edges 28 of the first IDC 8 are further opened to expose the conductors 36 to the second contact region 16.

With reference now to FIG. 3, the electrical terminal 2 is shown with the first electrical conductor 24 retained within the second IDC 10 and the second electrical conductor 25 retained within the first IDC 8. The second electrical conductor 25 has been inserted into the first IDC slot 8 and pressed down past cutting edges 28 that separate the insulation 38 to expose the conductive core 40 which is then engaged by the sides of walls 20,22 at the contact region 18. Note, that as the second IDC 10 is formed in flap 30 which extends from one side of leg 22, the insertion of the second electrical conductor 25 does not effect engagement of the first electrical conductor 24 within the second IDC 10. This assures that both electrical conductors 24,25 are reliably and securely electrically engaged by the electrical terminal 2.

Advantageously, the electrical terminal 2 is able to receive and electrically engage multiple stacked electrical conductors 24,25 such that the engagement of each conductor by the corresponding IDC does not effect the electrical interconnection of the other conductor. Furthermore, by stacking the electrical conductors 24,25 the area required for the electrical terminal 2 is minimized.

Figure 4:
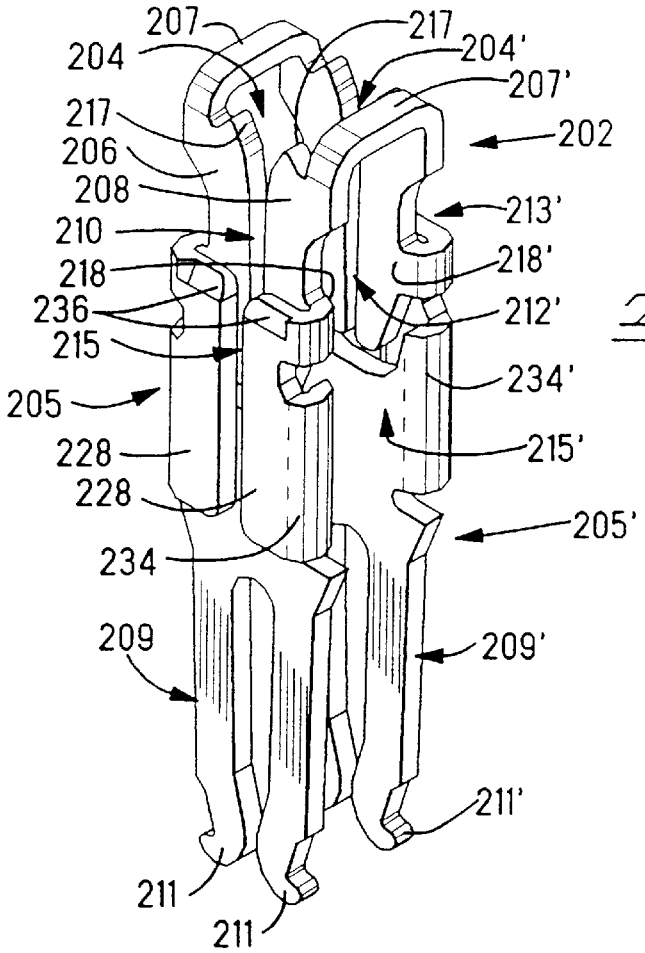
FIG. 4 is a perspective view of an alternative embodiment of an electrical terminal having an IDC slot: for receiving multiple conductors.
Figure 5:
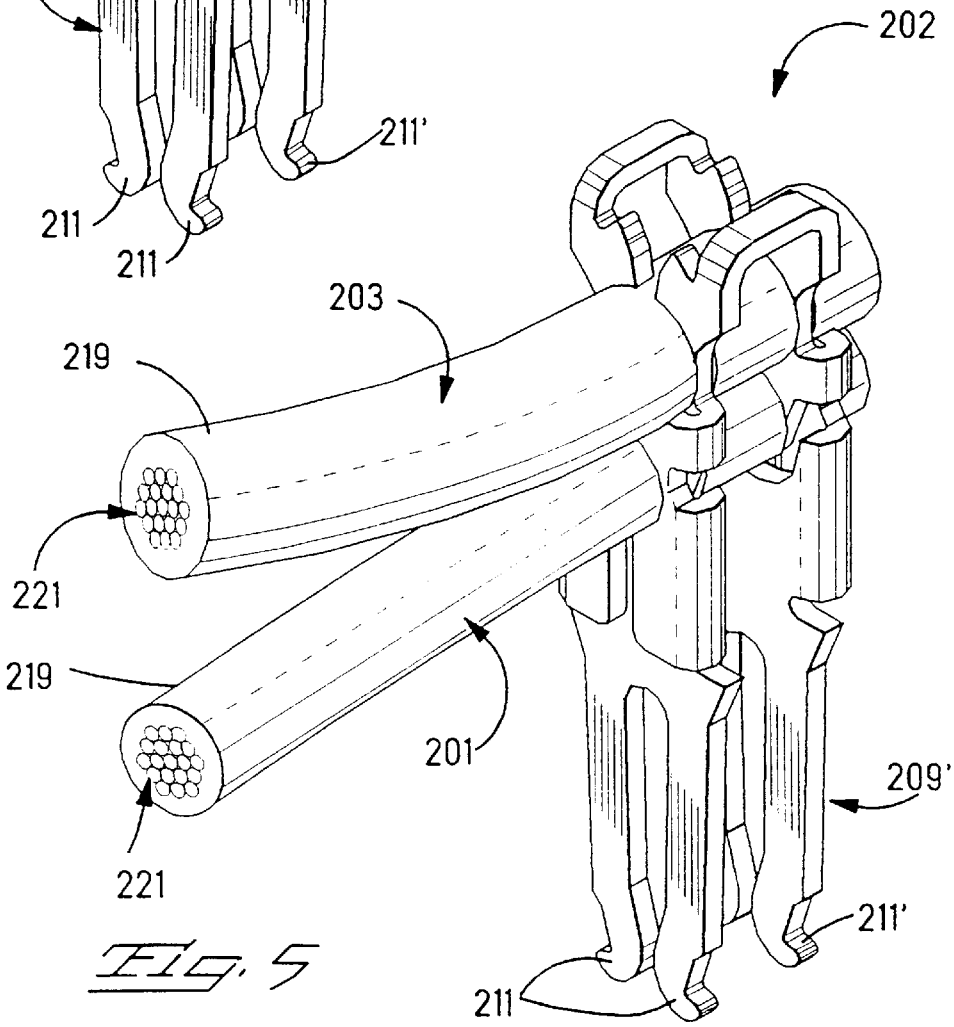
FIG. 5 is a perspective view of the electrical terminal of FIG. 4 showing a first conductor and a second conductor received within the IDC slot.

Referring to FIGS. 4–7, an alternative embodiment of an electrical terminal according to the present invention is shown generally at 202. In this embodiment, the electrical terminal comprises a pair of similarly configured legs 205, 205' extending generally parallel and opposing each other in a U-shaped manner from straps 207,207'. The particular embodiment described herein is a single piece unit formed from a material having the desired electrical and mechanical properties. Each leg 205,205' includes a device engaging portion 209 for engaging the electrical contact of an electrical device (not shown). In this embodiment, the device engaging portion 209 has a pair of opposing resilient arms 211. However, as stated above, the device engaging portion 209 may be configured in any manner that provides the proper interface with the mating structure. In addition to the device engaging portion 209, each leg 205,205' includes an IDC portion 213 for electrically engaging multiple conductors 201,203 (FIG. 5). The device engaging portion 209 and the IDC portion 213 are interconnected through intermediate portion 215.

The IDC portion 213 includes an IDC slot 204 defined by opposing walls 206,208. Each of these opposing wails 206,208 includes a cutting edge 217 for cutting the insulation 219 surrounding the conductive core 221 of the conductors 201,203, as will be described below.

Figure 6:
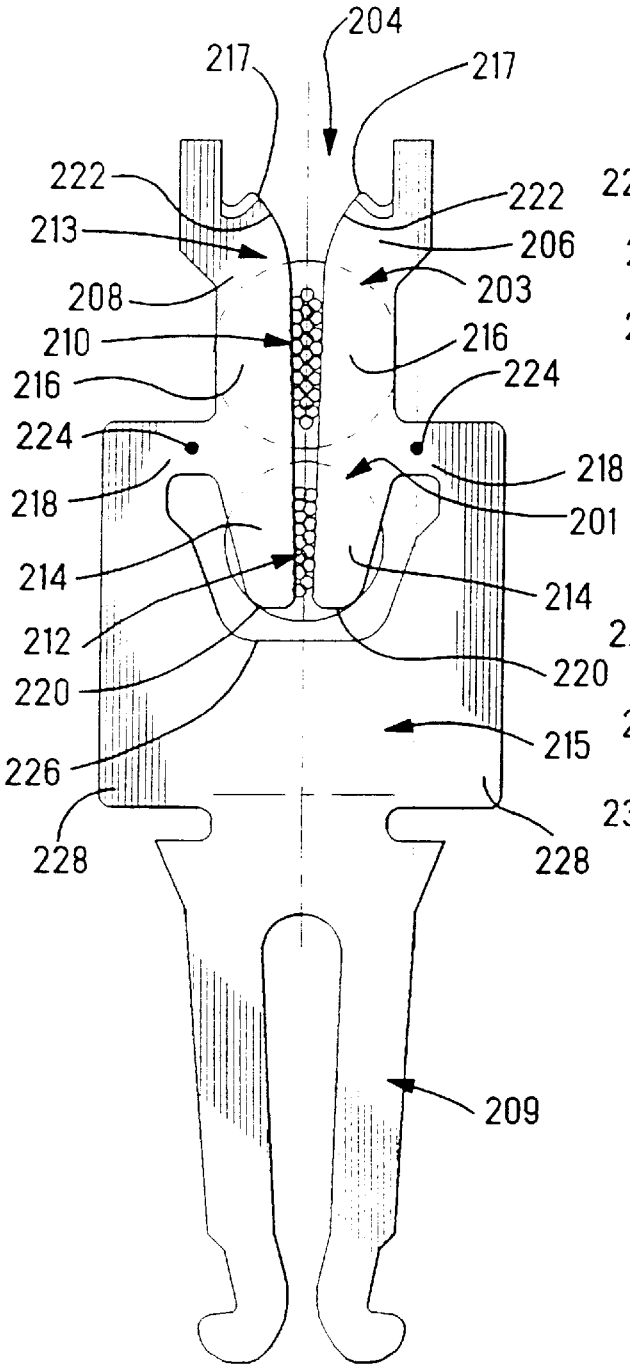
FIG. 6 is a plan view of part of the electrical terminal of FIG. 4 prior to bending.
Figure 7:
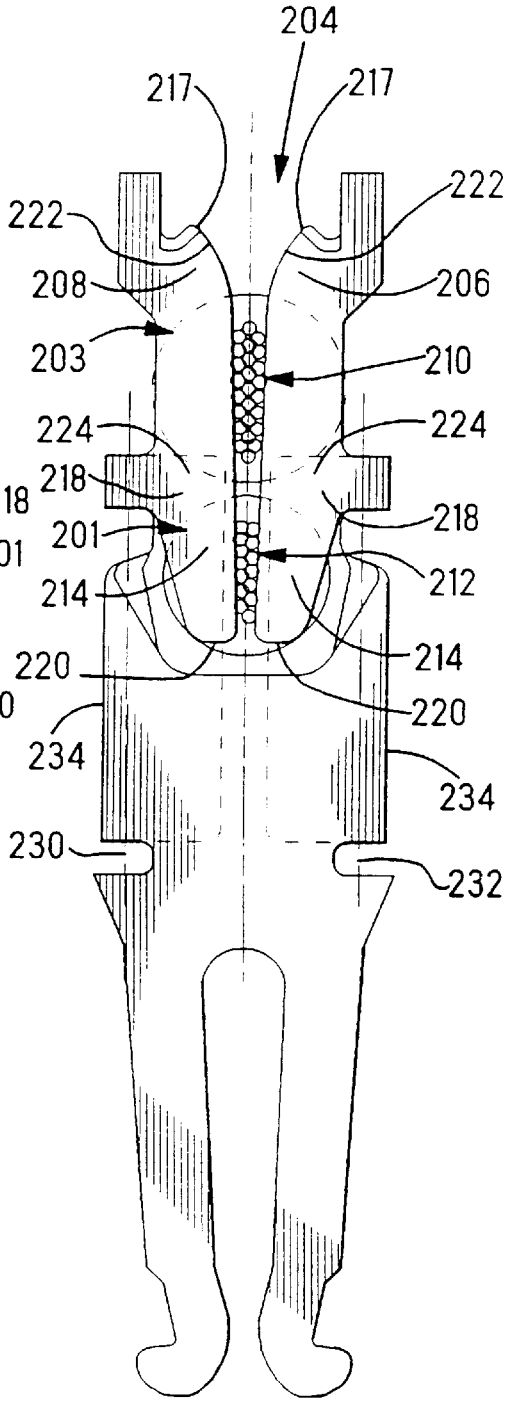
FIG. 7 is a plan view of the part of the terminal shown in FIG. 6 after bending.

As most easily observed in FIGS. 6 and 7, the IDC slot 204 will be now be more fully described. Opposing walls 206,208 define the IDC slot 204. Disposed along the IDC slot 204 are a first conductor receiving region 210 and a second conductor receiving region 212. The opposing walls 206,208 are interconnected with the intermediate portion 215 by way of a central bite 218. From this central bite region 218 extend oppositely directed opposing pairs of arms 214,216 which have free ends 220,222 respectively. Free ends 220 are defined by an opening 226 that, in this embodiment, has a relaxed U-shape that is in communication with the IDC slot 204. As can be readily observed in FIG. 6, a fulcrum 224 will exist between each of the contact regions 210,212, the operation of which will be described below. In order to reduce the width of the intermediate portion 215, while maintaining the strength of the central bite 218, ears 228 of the intermediate portion 215 are folded back about lines 230,232, as best seen in FIGS. 4 and FIG. 7. As this fold includes a portion of the relaxed U-shaped opening 226, the central bite 218 is unrestricted about the fold 234. Chamfered edges 236 may be provided upon ears 228 along walls 206,208 so that the insulation 219 of the conductor 201 that will be seated in the second conductor receiving region 212, may more easily pass thereover.

With reference now to FIGS. 5–7, the insertion of the insulated conductors 201,203 will now be described. As the first insulated conductor 201 is inserted into the IDC slot 204, the insulative coating 219 is pierced by cutting edges 217 to expose the conductive core 221. As the conductor 201 is further inserted into the IDC slot 204, free ends 222 of arms 216 will have a separating force exerted thereupon. As arms 216, along with arms 214 are part of opposing walls 206,208 that define the IDC slot, the exertion of a separating force at ends 222 will tend to bring ends 220 together by way of a pivot about the fulcrum 224. As the first conductor 201 passes the fulcrum 224, ends 222 will be biased together while ends 220 have a separating force imposed thereupon. When the conductor 201 is fully seated within the second conductor receiving region 212, a torque is exerted about the fulcrum 224 which is separating arms 214, which is opposed about the central bite 218. However, when the second conductor 203 is inserted into the IDC slot 204, once again the ends 222 are biased outward. In this instance, the conductive core 221 of the first conductor 201 is within the conductor receiving region 214 of the slot 204. This causes arms 214 to bite tightly against the conductive core 221 and prevents excessive splaying of ends 222 which could result in either ineffective piercing of the insulative coating 219 of the second conductor 203 or relaxation of the engagement of the conductive core 221 of second conductor 203 within the second conductor receiving region 210. While the embodiment described above has both of the conductors 201,203 being loaded from the same side of the IDC slot 204, it is envisioned that the conductors may be loaded from different sides of the fulcrum 224 by the incorporation of cutting edges at the ends 220.

Advantageously, therefore the electrical terminal 202 assures reliable electrical engagement of multiple conductors within a single IDC slot. As opposed to prior art devices, where insertion of a second conductor into an IDC slot will tend to degrade performance, by way of the fulcrum 224 located between the first conductor receiving region 210 and the second conductor receiving region 212, the insertion of a second conductor enhances the electrical engagement of both conductors.

We claim:

1. An electrical terminal comprising an insulation displacement contact portion having a first insulation displacement contact and a second insulated displacement contact for engaging respective insulated conductors in a stacked fashion wherein the insulation displacement contacts are defined by a single pair of arms which extend upwardly and downwardly from a fulcrum portion to respective free ends to form two pairs of arm portions pivotable about the fulcrum portion and defining a common slot with common contact surfaces therealong for receiving stacked conductors.

2. The electrical terminal of claim 1, further characterized in that the terminal includes an intermediate portion from which each of the arms are suspended by a bite.

3. The electrical terminal of claim 2, further characterized in that the bite is connected to the intermediate portion by an ear, the ear being folded over the intermediate portion.

4. The electrical contact of claim 2, further characterized in that a second set of insulation displacement contacts identical to that of the first set is included in the terminal.

5. An electrical terminal comprising an insulation displacement contact portion having a first insulation displacement contact and a second insulation displacement contact for engaging respective insulated conductors in a stacked fashion where the insulation displacement contacts are defined by a single pair of arms which each extend upwardly and downwardly from a fulcrum portion to free ends to form two pairs of arms wherein an axis defined by the fulcrum portions about which the two pairs of arms pivot is transverse to the longitudinal axis of the inserted conductors.

* * * * *